US012760554B2

(12) United States Patent
Migrala

(10) Patent No.: US 12,760,554 B2
(45) Date of Patent: Oct. 13, 2026

(54) FENCE RAIL BRACING SYSTEM

(71) Applicant: Joseph Migrala, Deptford, NJ (US)

(72) Inventor: Joseph Migrala, Deptford, NJ (US)

( * ) Notice: Subject to any disclaimer, the term of this patent is extended or adjusted under 35 U.S.C. 154(b) by 195 days.

(21) Appl. No.: 18/781,052

(22) Filed: Jul. 23, 2024

(65) Prior Publication Data

US 2025/0320749 A1 Oct. 16, 2025

Related U.S. Application Data

(60) Provisional application No. 63/632,673, filed on Apr. 11, 2024.

(51) Int. Cl.
*E04H 17/14* (2006.01)

(52) U.S. Cl.
CPC ..... *E04H 17/1447* (2021.01); *E04H 17/1439* (2013.01)

(58) Field of Classification Search
CPC ..... E04H 17/1426; E04H 17/1439; E04H 17/1417; E04H 17/1447; E04F 2011/1825; E04F 2011/1823
See application file for complete search history.

(56) References Cited

U.S. PATENT DOCUMENTS 4,586,697 A * 5/1986 Tornya ..... E04F 11/181 256/22
6,467,756 B1 * 10/2002 Elsasser ..... E04H 17/1413 52/832
6,595,497 B1 * 7/2003 Linford ..... E04H 17/16 256/19
7,934,699 B2 * 5/2011 Zell ..... E04H 17/168 256/65.02
10,640,985 B2 * 5/2020 Strehlow ..... E04F 11/1817
11,939,775 B2 * 3/2024 Giacometti ..... E04F 11/1834
12,442,184 B2 * 10/2025 Thomas ..... E04H 17/1456
2003/0089056 A1 * 5/2003 Retterer ..... E04C 3/29 52/223.8
2003/0213947 A1 * 11/2003 Takagi ..... E04H 17/1413 256/65.02
2008/0135823 A1 * 6/2008 Amendola ..... E04H 17/1439 256/59
2008/0142771 A1 * 6/2008 Amendola ..... E04H 17/1439 256/59
2008/0179580 A1 * 7/2008 McGinness ..... E04H 17/16 256/59
2009/0200531 A1 * 8/2009 Rowley ..... E04H 17/24 256/27
2020/0318382 A1 * 10/2020 Feng ..... E04H 17/1426

FOREIGN PATENT DOCUMENTS

EP 3103956 B1 * 2/2021 ..... E04H 17/1417
KR 20110047739 A * 5/2011 ..... E04H 17/26

* cited by examiner

*Primary Examiner* — Matthew R Mcmahon
(74) *Attorney, Agent, or Firm* — Stuart M. Goldstein

(57) ABSTRACT

A fence bracing system utilizes an elongated lower rail having a base rail component and an elongated upper rail component having a top rail. Each of the components house an X brace extending the length of the components. The X braces have an inner "X" shaped supporting member framed by an upper flat supporting rib member and a lower flat supporting rib member. The supporting members extend the length of the lower and upper rails.

8 Claims, 6 Drawing Sheets

FENCE RAIL BRACING SYSTEM

RELATED APPLICATION

This application claims the benefit of provisional application Ser. No. 63/632,673 filed on Apr. 11, 2024.

FIELD OF THE INVENTION

The present invention generally relates to enhanced fence bracing, and, more particularly, to a system for increasing the strength and durability of molded fence components, especially vinyl fence rails in fencing systems.

BACKGROUND OF THE INVENTION

Fences fabricated of vinyl or like molded material provide effective barriers which are relatively simple and cost effective to manufacture and, when well maintained, will last for many years. However, an inherent problem with such fencing is that some of its components, especially fence railings, will tend to sag or otherwise be distorted due to the passage of time and as a result of the effects of changing ambient weather conditions.

SUMMARY OF THE INVENTION

It is thus the object of the present invention to provide a fence rail bracing system for vinyl and like material fencing which strengthens and provides increased structural integrity and rigidity to the fence, thereby extending the durability and life of the fence.

These and other objects are accomplished by the present invention, a fence bracing system which utilizes rails having a base rail component and a top rail component, each component housing X braces extending the length of the components. Each X brace has an inner "X" shaped supporting member framed by an upper flat supporting rib member and a lower flat supporting rib member. The supporting members extend the length of the lower and upper rails.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
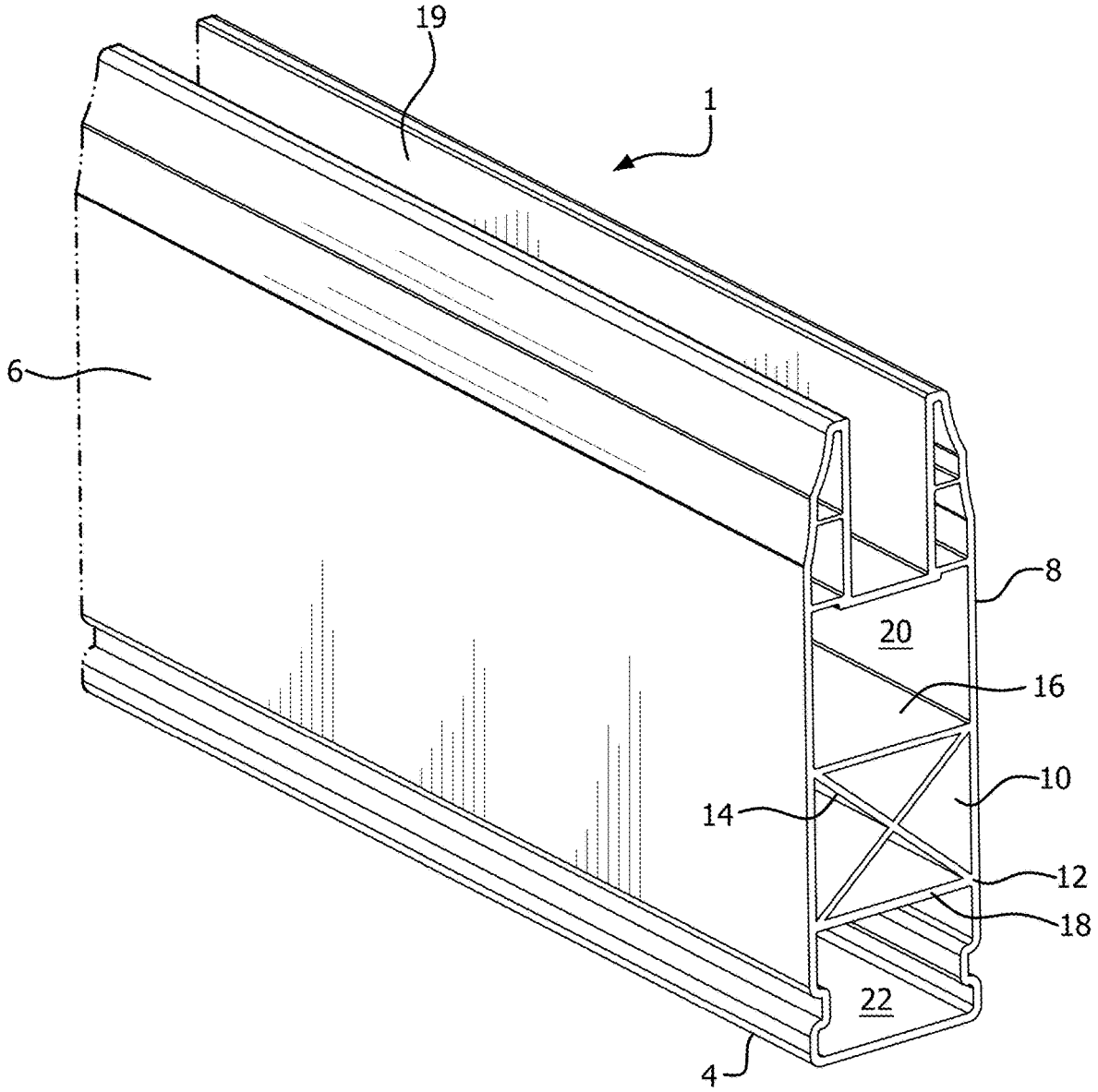
FIG. 1 is a perspective view of the lower rail of the present invention.
Figure 2:
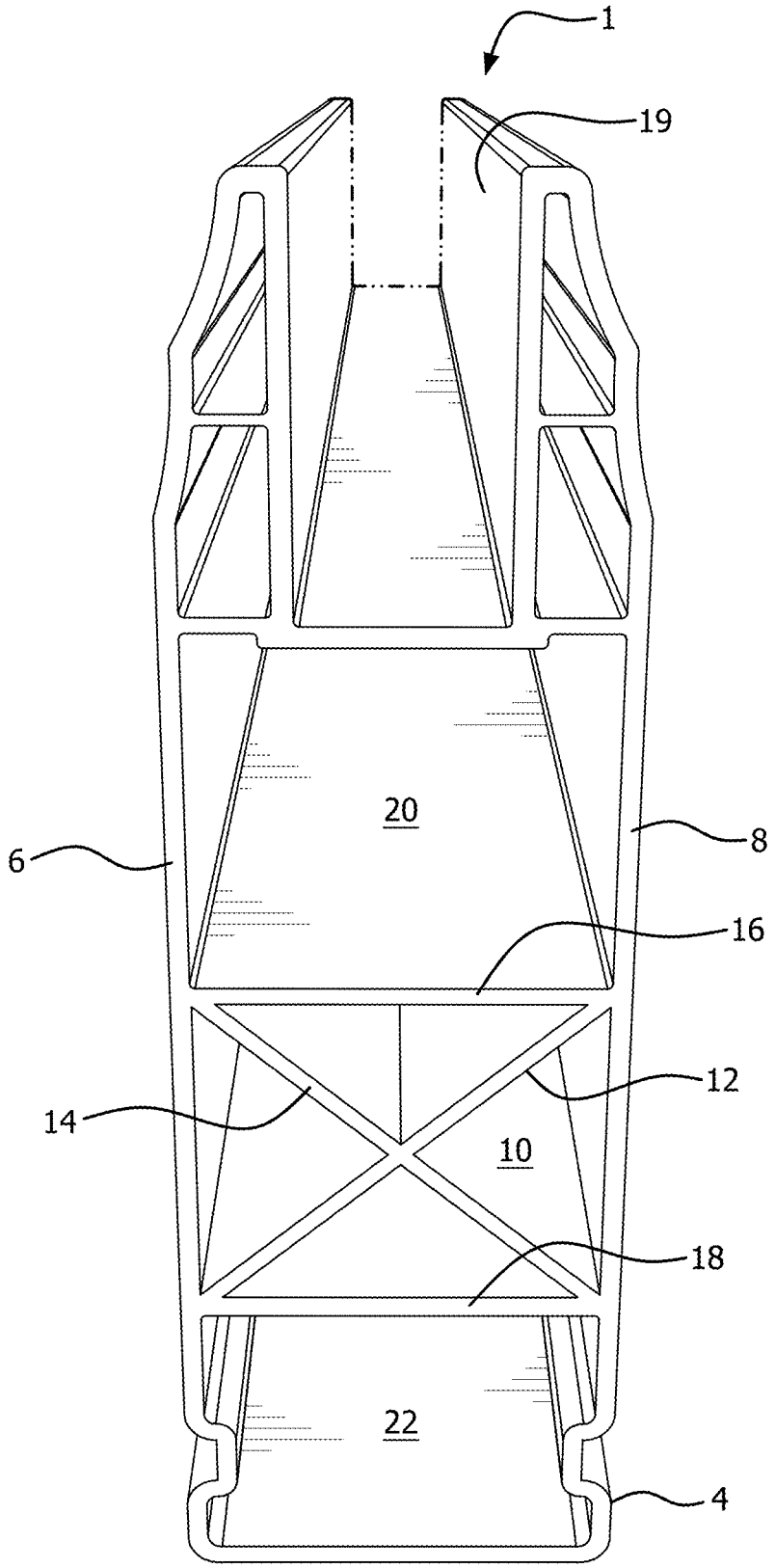
FIG. 2 is an end view of the lower rail of the present invention.
Figure 3:
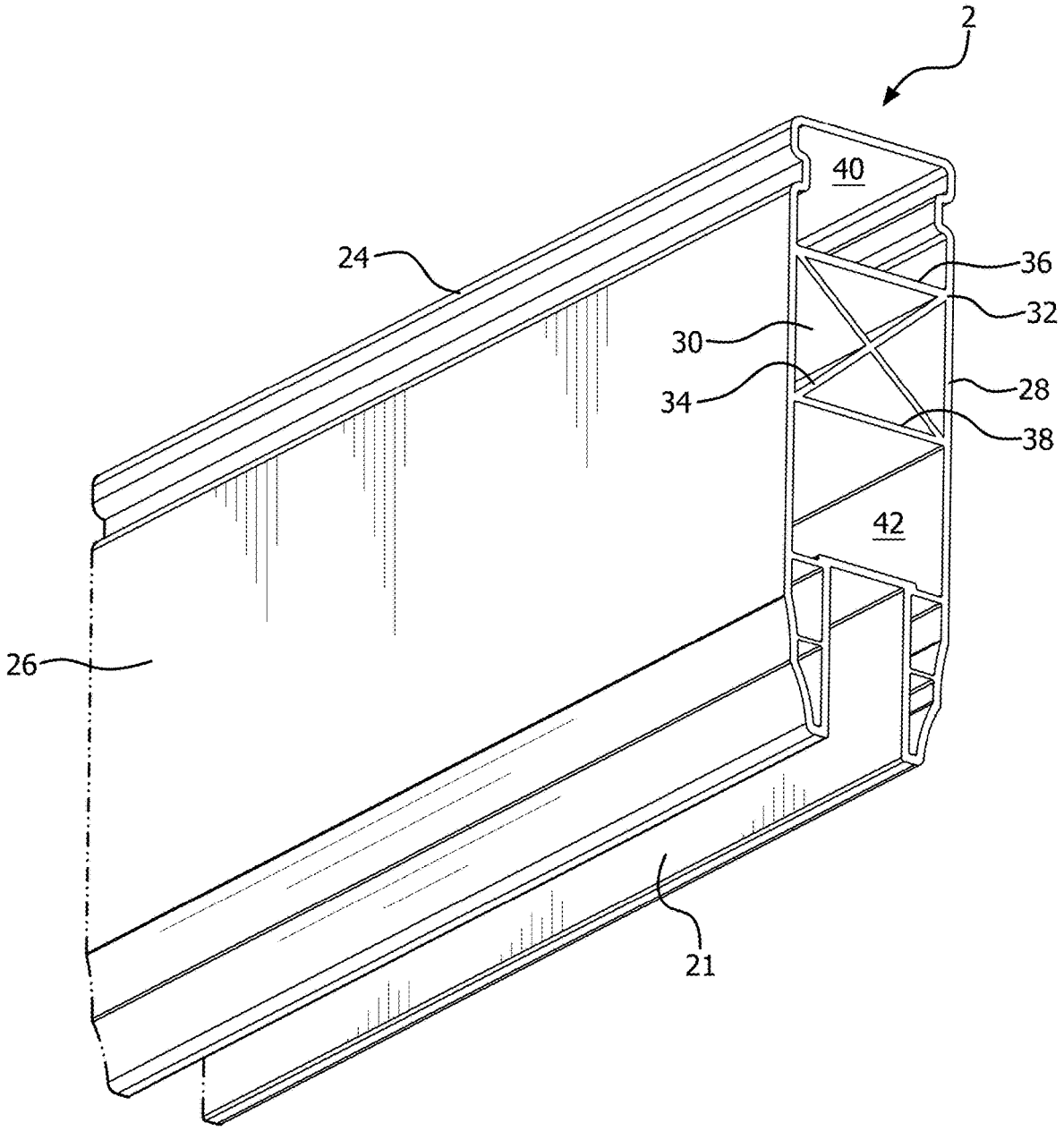
FIG. 3 is a perspective view of the upper rail of the present invention.
Figure 4:
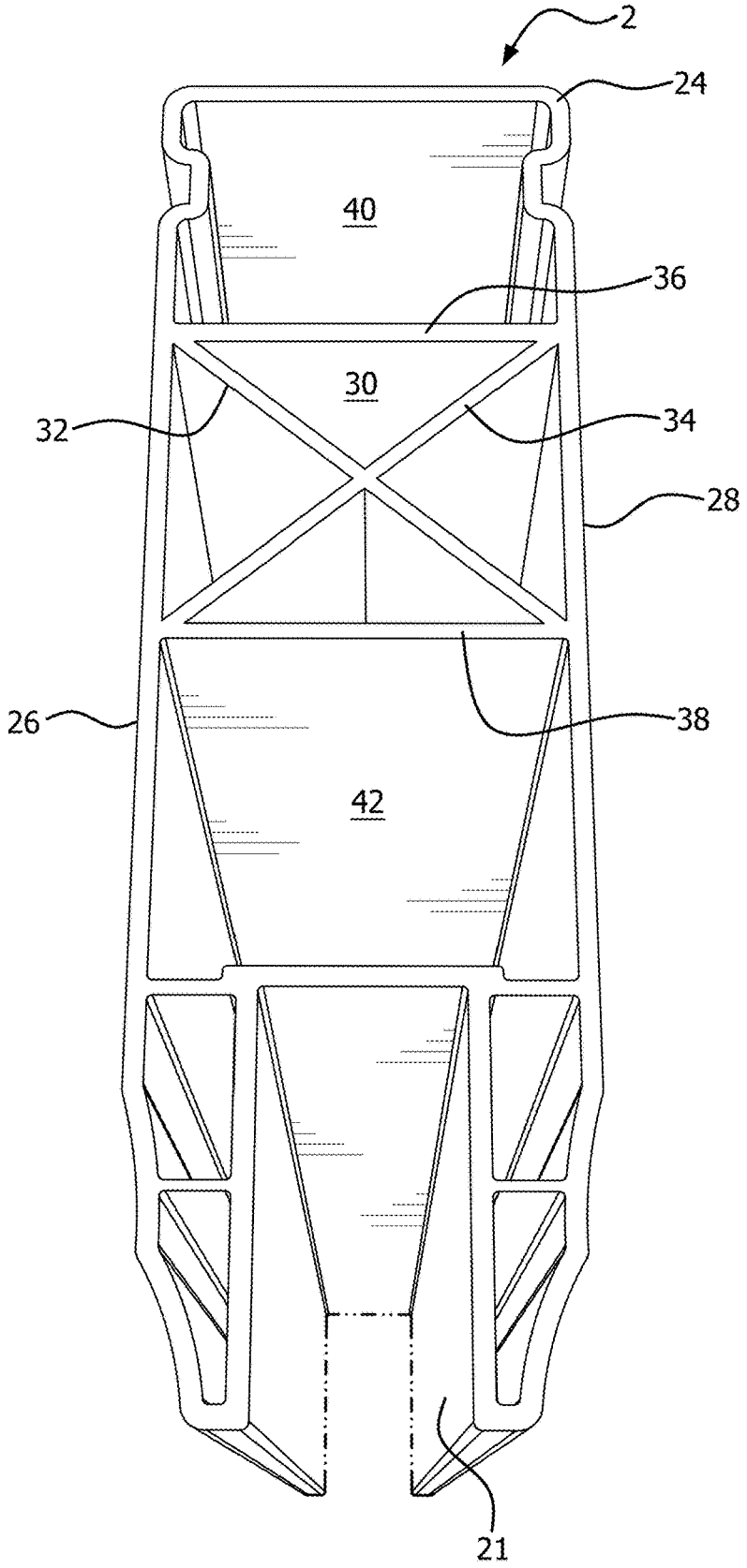
FIG. 4 is an end view of the upper rail of the present invention.
Figure 5:
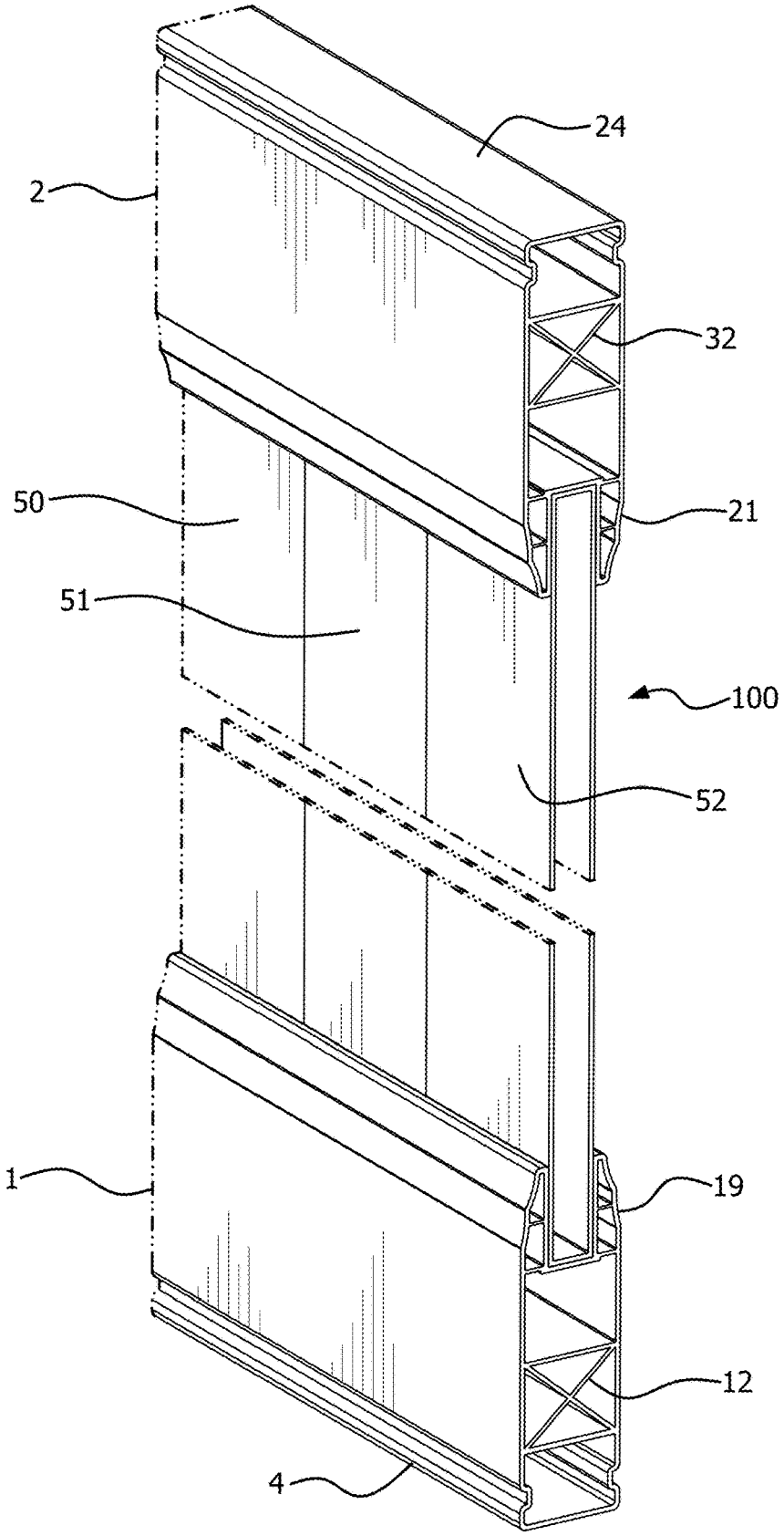
FIG. 5 is a perspective view of a section of a fencing system utilizing the components of the present invention.
Figure 6:
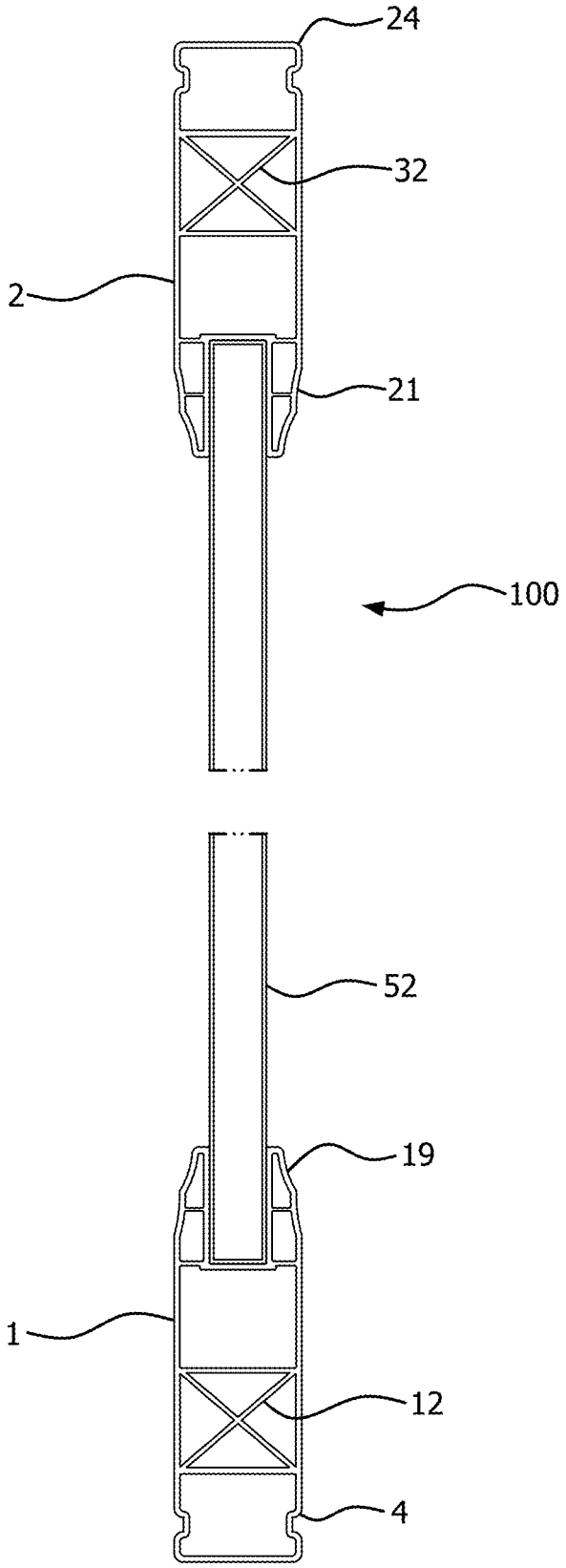
FIG. 6 is an end view of a section of a fencing system utilizing the components of the present invention.

Lower rail 1 of the present invention comprises base rail component 4 and lateral side walls 6 and 8 extending up from the base rail component. Each side wall extends the length of base rail component 4. Elongated space 10 extends up from is formed between side walls 6 and 8. This space also extends the length of the base rail component 4.

X brace 12 is housed within and extends the length of elongated space 10. X brace 12 comprises inner "X" shaped supporting member 14 framed by upper flat supporting rib member 16 and lower flat supporting rib member 18. "X" shaped supporting member 14 is located between upper supporting rib member 16 and lower supporting rib member 18.

Upper elongated space 20 is located over upper supporting rib member 16. Lower elongated space 22 is located beneath lower supporting rib member 18. Elongated channel member 19 is located over space 20.

Upper rail 2 of the present invention can be identical to lower rail 1. It comprises top rail component 24 and lateral sidewalls 26 and 28 extending down from and extending the length of the top rail component. Elongated space 30 is formed between sidewalls 26 and 28 and also extends the length of top rail component 24.

X brace 32 is housed within and extends the length of elongated space 30. X brace 32 comprises inner "X" shaped supporting member 34 framed by upper flat supporting rib member 36 and lower flat supporting rib member 38. "X" shaped supporting member 34 is located between upper supporting rib member 36 and lower supporting remember 38.

Upper elongated space 40 is located above upper supporting rib member 36. Lower elongated space 42 is located beneath lower supporting rib member 38. Elongated channel member 21 is located beneath space 42.

Fencing system 100 of the present invention comprises a plurality of pickets 50, 51 and 52 which extend between base rail component 4 of lower rail 1 and top rail 24 of upper rail 2. The ends of the pickets are received within channel members of 19 and 21 of base rail component 4 and top rail component 24, respectively.

The use of rails 1 and 2, which both incorporate X braces 12 and 24 in base rail component 4 and top rail component 24, will serve to materially lengthen and extend the life expectancy of a fencing system by preventing it from sagging, adding rigidity, and generally strengthening the overall structural integrity of the system.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A rail for vertical fencing, said rail comprising:

an elongated base rail component;

lateral side walls extending up from the base rail component and extending the length of the base rail component;

an elongated space formed between the side walls, the space extending the length of the base rail component;

an X brace, integrally formed with the base rail component, located within and extending the length of the elongated space, said "X-" X brace comprising an inner X "X" shaped supporting member having multiple diagonally extending crisscrossing brace elements, each brace element emanating from a corner of the elongated space such that the brace elements meet to form a continuous, uninterrupted "X" shape, the "X"

shaped supporting member being framed by an upper flat supporting rib member and a lower flat supporting rib member;

an upper elongated space located over the upper supporting rib member;

a lower elongated space located beneath the lower supporting rib member; and an elongated channel member located above the upper elongated space defining a channel space above the upper elongated space.

2. The rail as in claim 1 wherein the "X" shaped supporting member is located between the upper and lower supporting rib members.

3. The rail as in claim 1 wherein the rail is an integral, extruded vinyl component of the fencing.

4. A rail for vertical fencing, said rail comprising:

an elongated top rail component;

lateral side walls extending down from the top rail component and extending the length of the top rail component;

an elongated space formed between the side walls, said space extending the length of the top rail component;

an X brace, integrally formed with the top rail component, located within and extending the length of the space, said X brace comprising an inner "X" shaped supporting member having multiple diagonally extending crisscrossing brace elements, each brace element emanating from a corner of the elongated space such that the brace elements meet to form a continuous, uninterrupted "X" shape, the "X" shaped supporting member being framed by an upper flat supporting rib member and a lower flat supporting rib member;

an upper space located above the upper supporting rib member a lower space located beneath the lower supporting rib member; and an elongated channel member located below the lower elongated space defining a channel space below the lower elongated space.

5. The rail as in claim 4 wherein the "X" shaped supporting member is located between the upper and lower supporting rib members.

6. The rail as in claim 4 wherein the rail is an integral, extruded vinyl component of the fencing.

7. A fencing system comprising:

an elongated base rail component comprising lateral side walls extending up from the base rail component and extending the length of the base rail component, an elongated space formed between the side walls, the space extending the length of the base rail component, and an X brace, integrally formed with the base rail component, located within and extending the length of the space, said X brace comprising an inner "X" shaped supporting member having multiple diagonally extending crisscrossing brace elements, each brace element emanating from a corner of the elongated space such that the brace elements meet to form a continuous, uninterrupted "X" shape, the "X" shaped supporting member being framed by an upper flat supporting rib member and a lower flat supporting rib member;

an elongated top rail component comprising lateral side walls extending down from the top rail component and extending the length of the top rail component, a second elongated space formed between the side walls of the top rail component, said elongated space extending the length of the top rail component, and a second X brace, integrally formed with the top rail component, located within and extending the length of the second space, said second X brace comprising an inner "X" shaped supporting member having multiple diagonally extending crisscrossing brace elements, each brace elements emanating from a corner of the second elongated space such that the brace elements meet to form a second continuous, uninterrupted "X" shape, the second "X" shaped supporting member being framed by an upper flat supporting rib member and a lower flat supporting rib member;

an upper elongated space located over the upper supporting rib member of the base rail component, a lower elongated space located beneath the lower supporting rib member of the base member component, an upper elongated space located over the upper supporting rib member of the top rail component, and a lower elongated space located beneath the lower supporting rib member of the top rail component;

an elongated channel member located above the upper elongated space of the base rail component defining a channel space above the upper elongated space and a second elongated channel member located beneath the lower elongated space of the top rail component defining a channel space below the lower elongated space; and a plurality of parallel aligned pickets extending between the base rail component and the top rail component.

8. The fencing system as in claim 7 wherein both the base rail component and the top rail component are integral, extruded vinyl components.

* * * * *